United States Patent [19]

Laudig

[11] 4,165,911

[45] Aug. 28, 1979

[54] ROTATING COLLAR LOCK CONNECTOR FOR A COAXIAL CABLE

[75] Inventor: Ronald C. Laudig, Mechanicsburg, Pa.

[73] Assignee: AMP Incorporated, Harrisburg, Pa.

[21] Appl. No.: 844,870

[22] Filed: Oct. 25, 1977

[51] Int. Cl.[2] ..... H01R 13/54; H01R 17/04

[52] U.S. Cl. ..... 339/89 C; 339/90 C; 339/177 R

[58] Field of Search ..... 337/89 R, 89 C, 90 R, 337/90 C, 177 R

[56] References Cited

U.S. PATENT DOCUMENTS

| | | | |
|---|---|---|---|
| 2,730,684 | 1/1956 | Gutman | 339/90 R X |
| 2,785,384 | 3/1957 | Wickesser | 339/90 C |
| 4,070,751 | 1/1978 | Hogendobler | 339/177 R X |

*Primary Examiner*—Gerald A. Dost
*Assistant Examiner*—E. F. Desmond
*Attorney, Agent, or Firm*—AMP Incorporated

[57] ABSTRACT

A rotating collar lock connector for terminating the end of a coaxial cable in which all of the metal parts therein are either stamped and formed or drawn, as opposed to being machined. Further, since no solder is required and since assembly is accomplished entirely from one direction the connector can be assembled at a single rotary type assembly machine. The connector comprises a rear metal sleeve which receives the coaxial cable at a first end thereof. A rotatable metal collar has a flanged first end which is slipped over the first sleeve from the second end thereof until it abuts against protuberances formed on the surface of the first sleeve near said first end. A metal spring means, such as a spring washer, is then slipped over the first sleeve up to said collar flange. The flanged first end of a second metal sleeve is then press fitted over the second end of the first sleeve and against the spring washer to lock the collar on the first sleeve in such a manner that the spring washer provides a spring bias between the flanges of the collar and the second sleeve. A cylindrically-shaped dielectric spacer having a concentric aperture extending therethrough is then press fitted within the first and second sleeves. A generally cylindrical male terminal is then crimped around the stripped center conductor of the cable and subsequently press fitted into the aperture in the dielectric spacer of the connector. The cable braid is secured around the first end of the first sleeve by means of a metal ring which is crimped therearound.

1 Claim, 3 Drawing Figures

ROTATING COLLAR LOCK CONNECTOR FOR A COAXIAL CABLE

BACKGROUND OF THE INVENTION

This invention relates generally to rotating collar lock connector assemblies for coaxial cables and more particularly to an improved and inexpensive rotating collar lock connector assembly which can be completely assembled at a single work station, and wherein all of the metal parts can be either stamped and formed or drawn, and the method of manufacturing such a connector.

There are currently available several different types of rotating collar lock connector assemblies for coaxial cables. All of these prior art connectors employ a collar which is mated with another assembly to complete a connection from a coaxial cable or between coaxial cables. The rotating collar can be of the bayonet locking type with slots therein which mate with pins formed on the perimeter of the mating connector portion. In other forms of the connector the rotating collar is threaded and mates with threads on a mating connector portion. All of the known prior art connectors of this type utilize machined parts. In many of these connectors, in addition to the rotating collar, there is also employed one or two sleeves which are secured to each other by such means as soldering or brazing. The use of two sleeves is required for assembly purposes. More specifically, one of the sleeves fits around the dielectric of the coaxial cable with the braid of the cable being secured around the outer part of the sleeve. The second sleeve fits around the second end of the first sleeve and is soldered thereto and further usually has a flange formed on the end thereof against which a spring means is positioned. The collar is designed to also have a flange means thereon which is positioned on the other side of the spring means and retains the spring means between the flange on the second sleeve and the flange on the rotating collar.

The prior art devices are expensive to manufacture for several reasons. Specifically, the soldering operation is of necessity, a separate operation requiring separate handling of the parts to be soldered. The other words, sub-assemblies must be formed before the complete connector can be assembled. Secondly, all of the metal parts, including the two sleeves, the rotating collar and the center contact of the connector which fits around the center conductor of the coaxial cable, are all relatively expensive screw machine parts.

BRIEF STATEMENT OF THE INVENTION

It is a primary object of the invention to provide a rotating collar lock connector for coaxial cables in which all of the metal parts are either stamped and formed or drawn as opposed to being manufactured by a screw machine, and the method of manufacturing such a connector.

It is a second object of the invention to provide a rotating collar lock connector for a coaxial cable in which a complete assembly of the connector can be performed by a single rotating type of assembly machine having a plurality of work stations.

A third aim of the invention is to provide a rotating collar lock connector for coaxial cable that requires no sub-assemblies and in which all of the parts are assembled from the same direction so that the connector can be assembled by a single rotary type assembly machine.

It is a fourth aim of the invention to provide an inexpensive collar lock assembly for coaxial cable in which all of the metal parts are either stamped and formed or drawn, as opposed to being machined and which can be manufactured by a single rotary-type assembly machine having a plurality of work stations.

A fifth purpose of the invention is the improvement of collar lock connectors for terminating coaxial cables generally and the method of manufacturing such connectors.

In accordance with one embodiment of the invention there is provided a first drawn cylindrically-shaped rear shell having a first end thereof constructed to receive the end of the coaxial cable with the cable braid being positioned around said shell and with the cable dielectric and the center conductor extending into the rear shell. A stamped and formed bayonet type (BNC) collar having a flanged first end is slipped over the second end of said first rear sleeve until the flanged end thereof abuts burrs or lances which are formed near the first end of said first sleeve. Next a spring washer is slipped around the first sleeve inside said collar and is abutted against said first flange on said collar. Subsequently, a drawn cylindrically-shaped second sleeve having a second flange on the first end thereof is press fitted around the said first sleeve with said second flange trapping said spring washer between the flange on said second sleeve and the flange on said collar so that the movement of the collar in a direction away from the burrs on said first sleeve is resisted by the spring washer.

A ring gasket is then fitted around the second sleeve and in abutting relationship against the flange of the second sleeve on the side of said flange opposite that side which traps said spring washer. Subsequently, a cylindrically-shaped dielectric having a concentric aperture formed therein for receiving the center conductor of a cable is inserted into the first and second sleeves and locked into place by appropriate detent or crimping means. Finally, the stamped and formed tubular center conductor contact which has been crimped around the center conductor of the cable is inserted into and through the aperture in the connector dielectric.

In accordance with a feature of the foregoing invention all of the metal parts of the assembly are either drawn or, alternatively, stamped and shaped, thereby resulting in very substantial cost savings over prior art devices which employ screw machine parts.

In accordance with another feature of the invention the connector can be completely assembled by a single rotary assembly machine having a number of work stations, each of which stations perform one of the several operational steps required to complete the assembly of the present connector, as compared to the assembly of prior art connectors which require at least one soldering step in securing the two sleeves together.

BRIEF DESCRIPTION OF THE DRAWINGS

The afore-mentioned and other objects and features of the invention will be better understood from the following detailed description thereof when read in conjunction with the drawings in which:

FIG. 3 is an isometric view of a second form of the invention employing a threaded type collar in the connector.

DETAILED DESCRIPTION OF THE INVENTION

Figure 1:
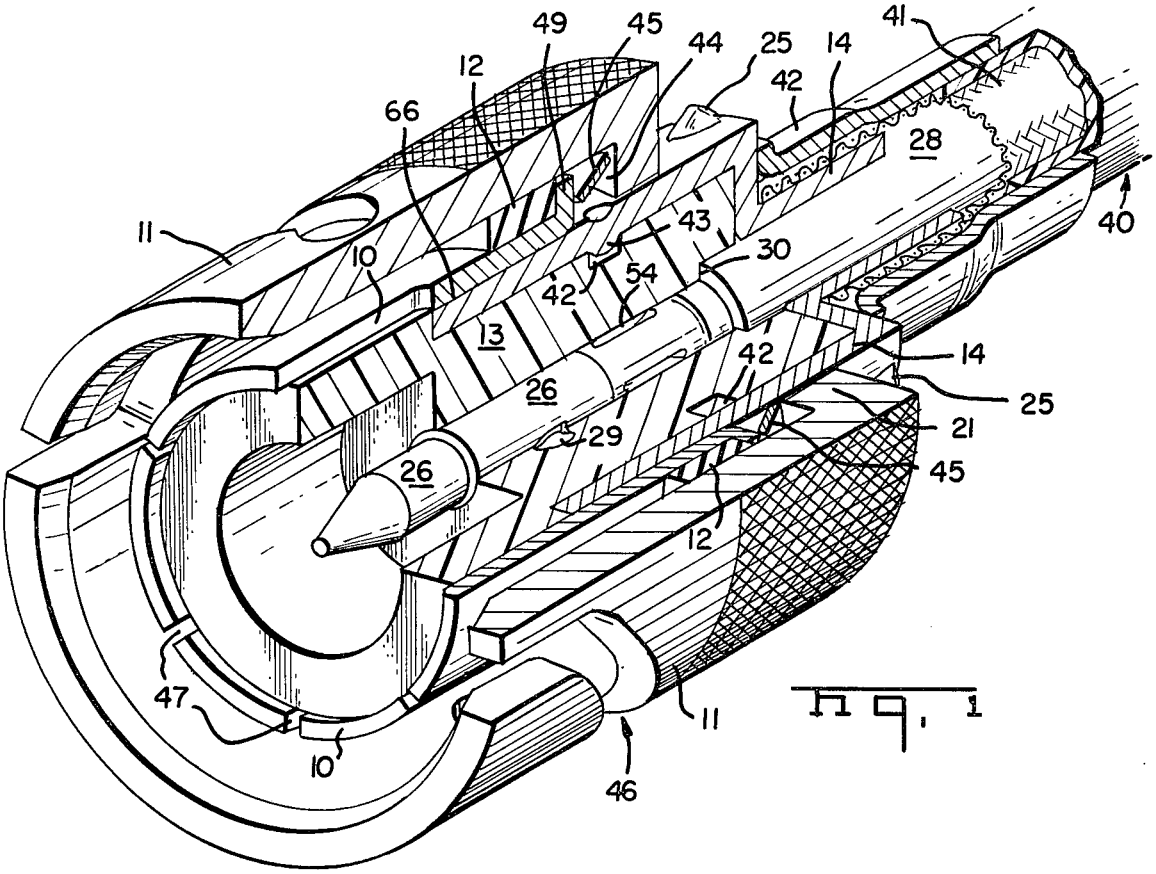
FIG. 1 is an isometric view of a form of the invention employing a bayonet type (BNC) collar in the connector.

Referring now to the isometric view of FIG. 1 the coaxial cable 40 is shown with its braid 41 positioned around the rear end of metal sleeve 14 of the connector. A crimpable ring 42 is crimped around the braid 41 to retain it on the rear shell 14.

The dielectric 28 of the connector extends into the connector until it abuts against the shoulder 30 of the dielectric spacer 13 of the connector. The center conductor 27 of the coaxial cable 40 continues to extend into an aperture 52 formed in the center contact 26 of the connector. The dielectric 13 is secured within the rear shell 14 by means of a recessed portion 42 thereof into which fits a detent 43 formed on the rear shell 14.

A rotatable BNC type locking collar 11 fits around said rear shell 14 and has a flange portion 21 which abuts against burrs or tangs 25 formed in said rear shell 14 and limits the movement of the collar 11 in the right hand direction in FIG. 1. Such collar 11 has helically patterned grooves 46 formed therein to mate with pins on the perimeter of a mating cylindrically-shaped female connector (not shown in the Figures).

A front shell 10 of a generally cylindrical shape and having a flanged end portion 49 formed thereon is press fitted around the front portion of the rear shell 14 with the flange 49 cooperating with the flange 21 of collar 11 to form a toroidally shaped cavity 44 therein which retains the Bellville type spring washer 45. More specifically, the washer 45 is retained between the flange 49 of the front shell 10 and the flange 21 of the rotatable collar 11 with the entire assembly being secured together by press fitting the front shell 10 upon the rear shell 14 along the surface 66.

A gasket 12 is then inserted on the outside of the front shell 10 and abuts against flange 49 of front shell 10 to provide a resilient surface against which the mating female connector half (not shown in FIG. 1) can abut.

The steps of manufacture of the structure of FIG. 1 are as follows and are listed in the order in which they are completed:

A. The collar 11, which is stamped and formed, is slipped over the rear shell 14 with the flange 21 of collar 11 abutting against the tangs 25 of rear shell 14.

B. The Bellville-type spring washer 45 is installed over said rear shell 14 and against flange 21 of rotatable collar 11.

C. The front shell 10 is force fitted over rear shell 14 with the spring washer 45 being retained between flange 49 of front shell 10 and flange 21 of rotatable collar 11.

D. The gasket 12 is installed over front shell 10 and caused to abut against the flange 49 of said front shell 10.

E. The coaxial cable is dressed in the manner indicated in FIG. 1 before installation thereof in the connector.

F. The center conductor 27 of the coaxial cable is inserted into and crimped within the male center contact 26 externally of the other portion of the assembled connector and usually at the user's facilities. The crimping is indicated by reference character 54.

G. The dressed coaxial cable with the center conductor contact 26 crimped over the center conductor 27 thereof is inserted into the aperture 51 of dielectric spacer 13 of the connector until the dielectric 28 of the coaxial cable abuts against the shoulder 30 of dielectric spacer 13 of the connector and with the braid 41 of the coaxial cable positioned outside of the rear shell 14 of the connector. Contact 26 is retained within spacer 13 by means of lances 49 or other suitable friction means.

H. The crimpable ring 42, which had previously been slipped around the coaxial cable 40 before installation into the connector is moved forward and over that portion of the braid which is positioned around the rear shell 14.

I. The crimpable ring 42 is crimped to thereby secure the coaxial cable 40 within the connector.

It is to be noted that in the usual manufacturing and marketing of the invention the application of the connector to the coaxial cable will ordinarily be done in the user's facilities. Accordingly, the dressing of the end of the coaxial cable, the crimping of the male center contact 26 and the insertion of the male pin 26 into the connector will ordinarily all be done at the user's facilities. Also, of course, the crimping of the braid collar 42 around the braid over the end of the rear shell 14 will be done at the user's facilities.

Figure 2:
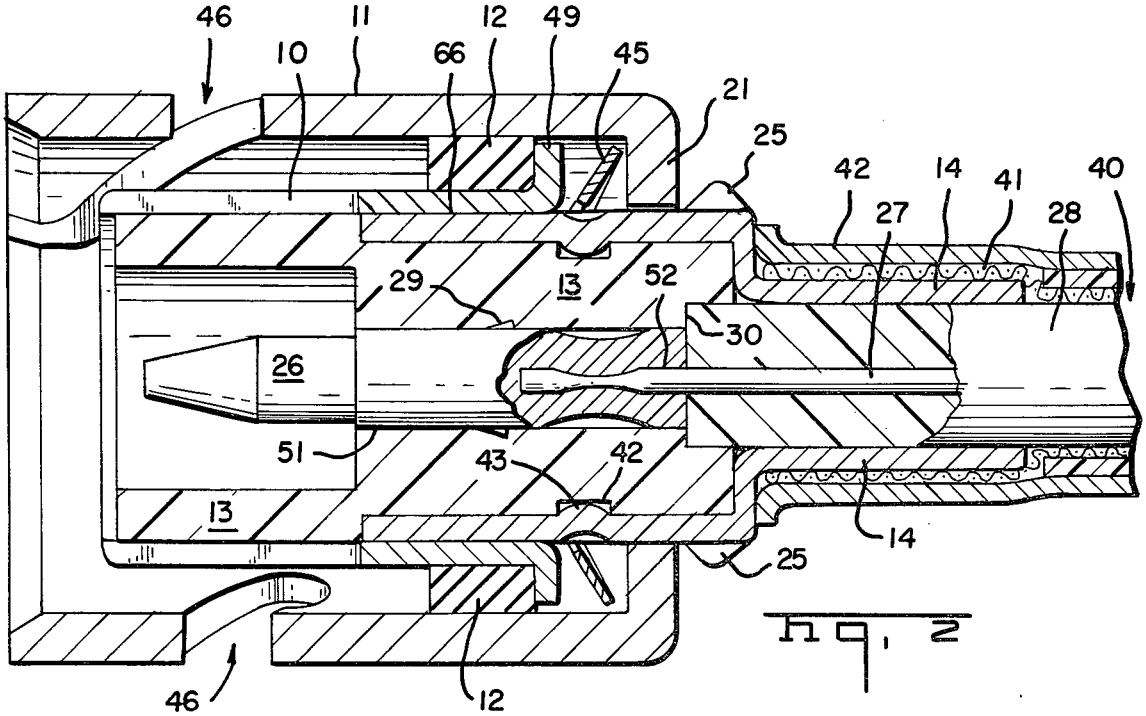
FIG. 2 is a sectional view of the structure shown in FIG. 1 taken along the plane 2—2.
Figure 7:
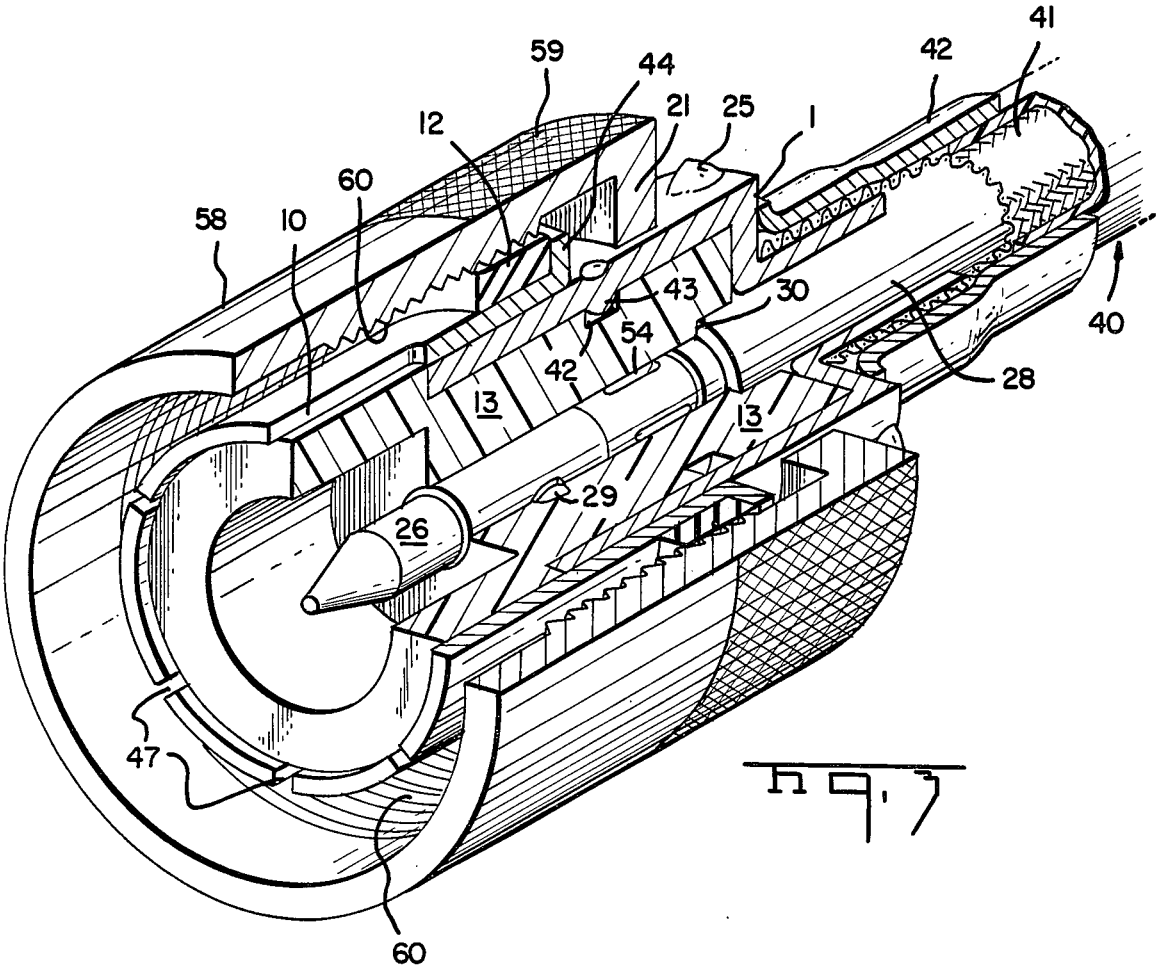

Referring now to FIG. 2 there is shown a sectional view of the structure of FIG. 1. Corresponding parts of FIGS. 1 and 2 are identified by the same reference characters.

In FIG. 3 there is shown an isometric view of another form of the invention which employs a rotatable threaded collar identified by reference character 58, in lieu of the BNC type collar of the structure of FIGS. 1 and 2. The threaded collar 58 has a knurled portion 59 and a threaded portion 60 which mates with a threaded portion on a mating connector portion (not shown). An additional difference between the structure of FIG. 1 and FIG. 3 is that in FIG. 3 there is no spring washer between flange 44 of front shell 10 and flange 21 of threaded collar 58 as there is in the structure of FIGS. 1 and 2.

Either or both of the two sleeves 10 and 14 can be drawn or, alternatively, stamped and formed. The rotating collars 11 and 58 and the tubular center contact 26 preferably are stamped and formed. Any of the parts can be made by screw machine, if desired, but at a higher cost.

It is to be understood that the forms of the invention shown and described herein are preferred embodiments thereof and various changes can be made in the configuration of the various elements, such as the substitution of the different type of springs for the Bellville-type spring washer 45 of FIG. 1, without departing from the spirit or scope of the invention.

I claim:

1. A connector for a coaxial cable, comprising:

A seamless metal first shell having a reduced cylindrical first section and an enlarged cylindrical second section provided with a lip, said first shell having a radial shoulder at the junction of said first and second sections, a one piece dielectric spacer having a reduced cylindrical first portion slideable along and intimately encircled by said second section and impinged against said shoulder, said spacer including an enlarged cylindrical second portion projecting outwardly of said second section and having a radial shoulder seated against said lip, a coupling sleeve having at one end a radially inwardly projecting flange freely rotatably received over said second section, a seamless second shell slideably received over and intimately encircling said second portion and said second section and being press fit over said second section, a radially outwardly projecting flange on said second shell cooperating with the flange of said sleeve to form an annular cavity, a spring washer received in said cavity, said spacer having a coaxial bore therethrough provided with a first counterbore in an end of said first portion and second counterbore in an end of said second portion, a coaxial cable having a center conductor protruding from an end of an encircling dielectric layer and an encircling conductive sheath, said sheath being received over said first section and being electrically connected thereto, said center conductor being connected to an elongated metal contact, said contact being slideably received in said bore and projecting outwardly into said second counterbore, and said end of said dielectric layer projecting through said first section and being intimately encircled by said first counterbore.

* * * * *